United States Patent [19]

Hirukawa

[11] Patent Number: 4,973,274

[45] Date of Patent: Nov. 27, 1990

[54] SHIFT ASSISTING DEVICE

[75] Inventor: Itsushi Hirukawa, Hamamatsu, Japan

[73] Assignee: Sanshin Kogyo Kabushiki Kaisha, Hamamatsu, Japan

[21] Appl. No.: 297,701

[22] Filed: Jan. 17, 1989

[51] Int. Cl.[5] ..... B63H 21/21; B60K 41/08

[52] U.S. Cl. ..... 440/1; 74/851; 440/86

[58] Field of Search ..... 440/1, 75, 86; 74/851, 74/852

[56] References Cited

U.S. PATENT DOCUMENTS

| | | | |
|---|---|---|---|
| 4,231,316 | 11/1980 | Bland et al. | 440/86 |
| 4,270,414 | 6/1981 | Tellert | 74/851 X |
| 4,432,734 | 2/1984 | Bland et al. | 440/1 |
| 4,525,149 | 6/1985 | Broughton et al. | 440/86 X |

*Primary Examiner*—Sherman Basinger

*Attorney, Agent, or Firm*—Ernest A. Beutler

[57] ABSTRACT

A shift assisting mechanism for a marine outboard transmission that includes a sensing device comprised of a pair of relatively movable levers with pressure responsive switches being effective to transmit movement between the levers and provide a shift controlling signal when the resistance to movement exceeds a predetermined value.

5 Claims, 4 Drawing Sheets

SHIFT ASSISTING DEVICE

BACKGROUND OF THE INVENTION

This invention relates to a shift assisting device and more particularly to an improved, compact shift assisting device for a transmission such as a marine propulsion transmission.

Many forms of transmissions employ dog clutching elements that are moved into engagement with driving or driven members so as to effect a driving connection. For example, such transmissions are frequently used in the forward neutral reverse transmissions of marine propulsion units and such an arrangement is shown in FIG. 1.

Referring specifically to FIG. 1, there is depicted an input shaft 11 that is coupled in a suitable manner to a prime mover such as a remotely positioned internal combustion engine and which has affixed to its lower end a bevel gear 12 of a forward neutral reverse transmission, indicated generally by the reference numeral 13. The driving gear 12 is enmeshed with a pair of diametrically opposed counter rotating driven bevel gears 14 and 15 that are journaled in a suitable manner on a propeller shaft 16 for driving a propeller (not shown).

A dog clutching sleeve 17 has a splined connection to the propeller shaft 16 and oppositely facing dog clutching teeth that are adapted to be slid into engagement with corresponding dog clutching teeth 18 and 19 formed integrally with the gears 14 and 15 respectively. When the dog clutching sleeve 17 is in a neutral position, the gears 14 and 15 will idle on the shaft 16 and there will be no drive transmitted from the driving shaft 11 to the propeller shaft 16. However, when the dog clutching sleeve 17 engages the gear 14 the shaft 16 will be driven in a forward direction and when the dog clutching sleeve 17 engages the gear 15, as shown in FIG. 1, the propeller shaft 16 will be driven in a reverse direction.

The control of the dog clutching sleeve is accomplished by means of a remotely positioned shift lever 21 that is connected to the dog clutching sleeve 17 by a motion transmitting mechanism including a shift assisting device indicated generally by the reference numeral 22. The motion transmitting mechanism includes an input Bowden wire actuator 23 that is connected at one end to the shift lever 21 and at its opposite end to one end of a lever 24 that is pivotally supported on a plate 25 of the shift assisting mechanism 22. A second Bowden wire actuator 26 is connected at one end to the lever 24 and at the other end to a bell crank 27 which is operative, upon its pivotal movement, to effect movement of the dog clutching sleeve 17 and the afore noted shifting operation.

The shift assisting mechanism 22 includes a lever 28 that is pivotally supported on the plate 25 and has one of its ends affixed to one end of a protective sheath 29 of the Bowden wire actuator 26. When there is a resistance to shifting, the protective sheath 29 will shift in position and pivot the lever 28. This will actuate a proximity switch 31 which then send out a control signal to a shift assisting device. Such shift assisting devices conventionally slow the speed of the powering prime mover that drives the drive shaft 11 so as to relieve the transmission 13 from excess load and facilitate shifting. This may be done in a variety of manners such as by interrupting the ignition, or slowing the engine by closing a throttle valve or similar methods.

The disadvantage of the type of prior art construction as shown in FIG. 1 is that it is relatively complex and requires a number of different connections which may have to be adjusted. That is, the connection of the wire actuators 23 and 26 to the lever 24 and the relationship of the Bowden wire sheath 29 to the lever 28 are all critical. In addition, it should be readily apparent, the construction is somewhat bulky.

It is, therefore, an object of this invention to provide an improved shift assisting device for a transmission.

It is a further object of this invention to provide an improved, compact and highly reliable shift assisting device for a transmission such as a marine transmission.

SUMMARY OF THE INVENTION

This invention is adapted to be embodied in a shift assisting device for a transmission that is comprised of a shift controlling member, a transmission controlling member and motion transmitting means for transmitting movement of the shift controlling member into movement of the transmission controlling member. In accordance with the invention, the motion transmitting means includes a first element movable with the shift controlling member and a second element movable with the transmission controlling member. Pressure responsive switch means are interposed between the elements and transmit forces between them. The pressure responsive switch means provides a shift assist signal when the resistance to movement of the second element exceeds a predetermined value.

DETAILED DESCRIPTION OF THE PREFERRED EMBODIMENT OF THE INVENTION

Figure 1:
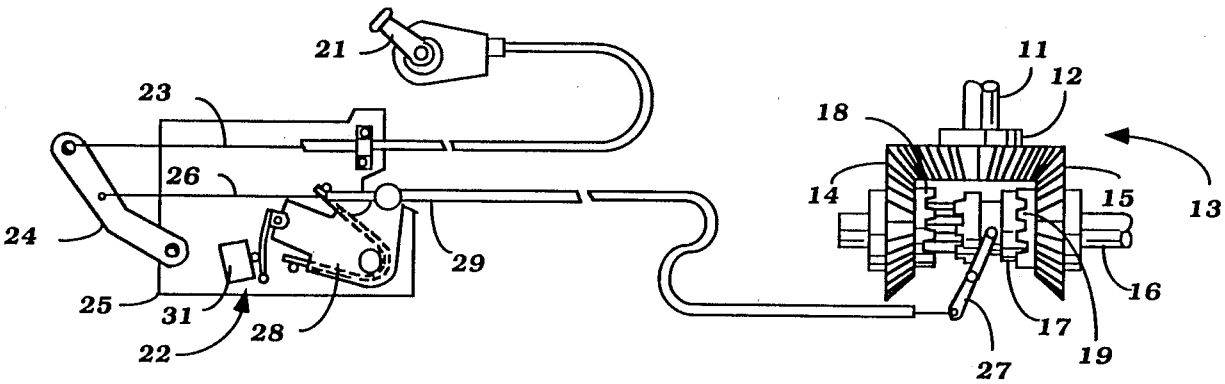
Figure 1 Prior Art
FIG. 1 is a partially schematic view of a prior art type of shift assisting device used in conjunction with a marine transmission.
Figure 2:
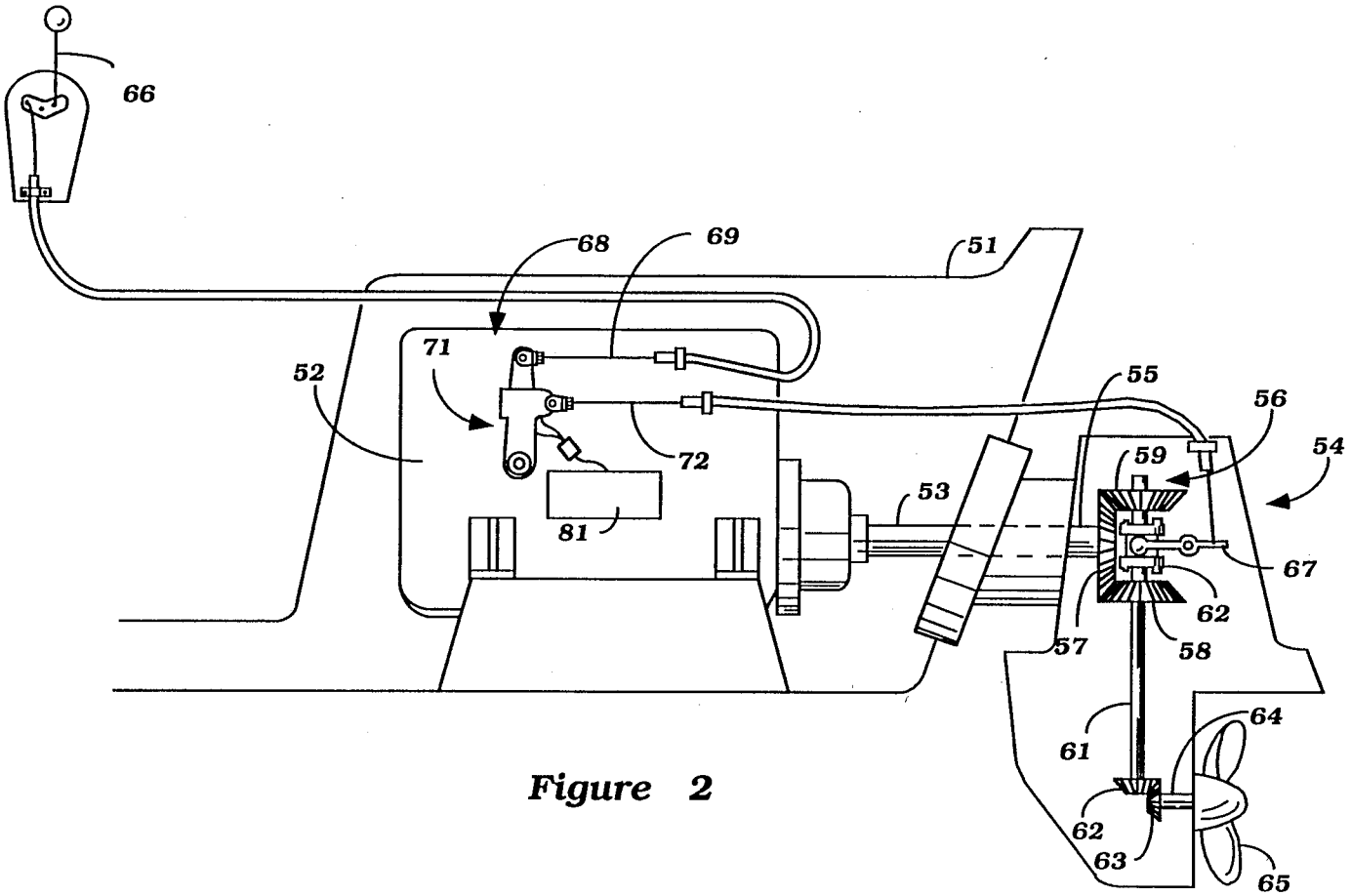
FIG. 2 is a side elevational view of an inboard/outboard drive having a forward neutral reverse transmission incorporating a shift assisting mechanism constructed in accordance with an embodiment of the invention.

Referring now in detail initially to FIG. 2, a water craft 51 having an inboard/outboard drive constructed in accordance with an embodiment of the invention is depicted in partially schematic form. The inboard/outboard drive is comprised of an internal combustion engine 52 that is mounted within the hull of the water craft 51 and which drives an output shaft 53 that extend through the transom of the water craft 51. Positioned on the rear of the transom is an outboard drive unit, indicated generally by the reference numeral 54 and which is comprised of an input shaft 55 that is coupled to the engine output shaft 53 by means of a universal joint so as to permit the convention steering and tilt and trim movement of the outboard drive 54. It should be noted that, although the invention is described in conjunction with an inboard/outboard drive, it may be equally well practiced with outboard motors per se which conventionally use the same type of transmission to be hereinafter described. Alternatively, certain facets of the invention may be utilized with other types of transmissions.

The input shaft 55 drives a forward neutral reverse transmission, indicated generally by the reference numeral 56 and which is substantially the same as the prior art type of construction previously described. In this embodiment, however, the input shaft 55 extends horizontally and drives a driving bevel gear 57 that is enmeshed with a pair of counter rotating driven bevel gears 58 and 59 that rotate about a vertically extending axis and are journaled on a drive shaft 61. A dog clutching sleeve 62 has a splined connection to the drive shaft 61 and is operative to drive the drive shaft 61 in selected forward, neutral or reverse conditions as afore described.

A bevel gear 62 is affixed to the lower end of the drive shaft 61 and is enmeshed with a driven bevel gear 63 that is fixed to a propeller shaft 64 for driving a propeller 65 in selected forward or reverse conditions.

The transmission 56 is controlled by means of a remotely positioned shift lever 66 that is coupled by a motion transmitting mechanism, to be described to a bell crank 67 that operates the dog clutching sleeve 62 in the same manner as was described in conjunction with the prior art. The motion transmitting mechanism also includes a shift assisting device indicated generally by the reference numeral 68 which is, in the illustrating embodiment mounted on the side of the engine 52.

The motion transmitting mechanism includes a first wire actuator 69 that is connected at one end to the shift lever 66 and at its other end to a lever arm assembly indicated generally by the reference number 71 and having a shift sensing device constructed in accordance with an embodiment of the invention. A second Bowden wire actuator 72 is connected at one end to the lever arm assembly 71 and at is opposite end to the bell crank 67 for effecting pivotal movement of the bell crank 67 and shifting of the dog clutching sleeve 62.

The lever arm assembly 71 includes a first lever arm 73 that is pivotally supported on a pivot bolt 74 affixed to the engine 52 in a suitable manner. The wire actuator 69 carries a coupling that has a pivotal connection by a pin 75 to the outer end of the lever arm 73. The lever arm 73 has an outwardly extending projection 76 on which a pair of oppositely facing pressure responsive switches 77, which may be of the piezoelectric type, are affixed in a suitable manner. The switches 77 have leads 78 that are connected by means of a coupling 79 to a conductor 80 which goes to a shift assisting control circuit 81. The control circuit 81 is adapted to reduce the torque of the engine 62 so as to assist shifting as by interrupting the ignition circuit of the engine in any known manner or by any of the other known ways.

Figure 3:
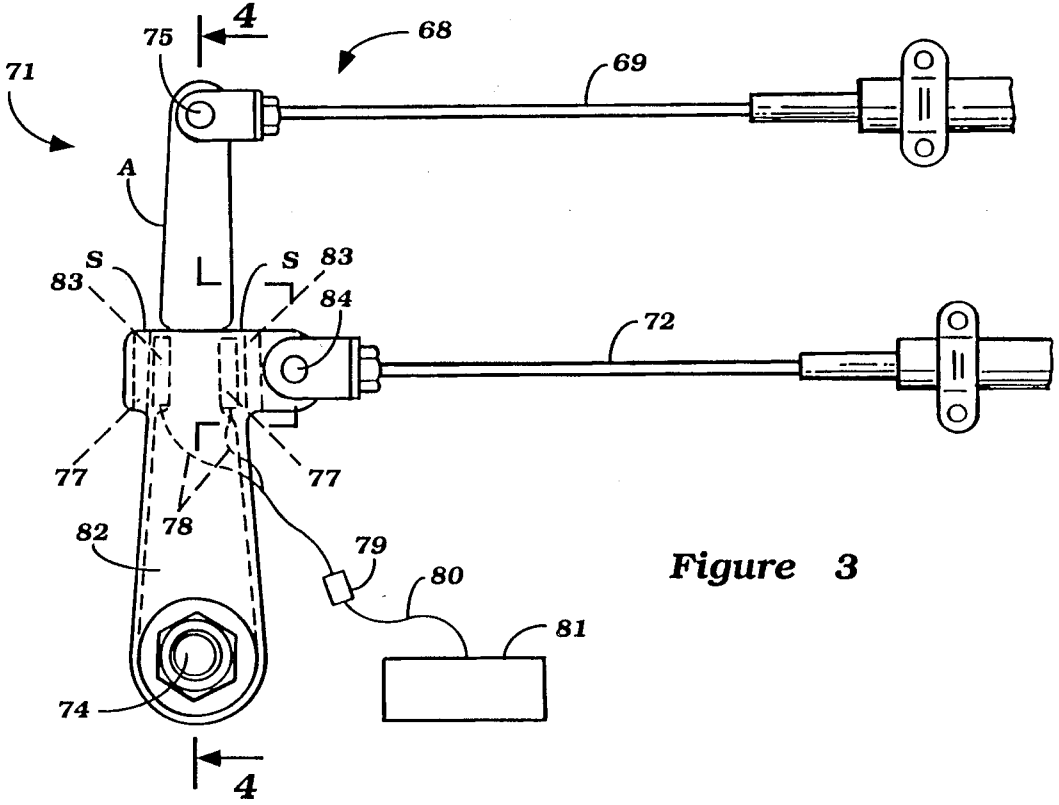
FIG. 3 is an enlarged side elevational view showing the shift assisting mechanism.
Figure 5:
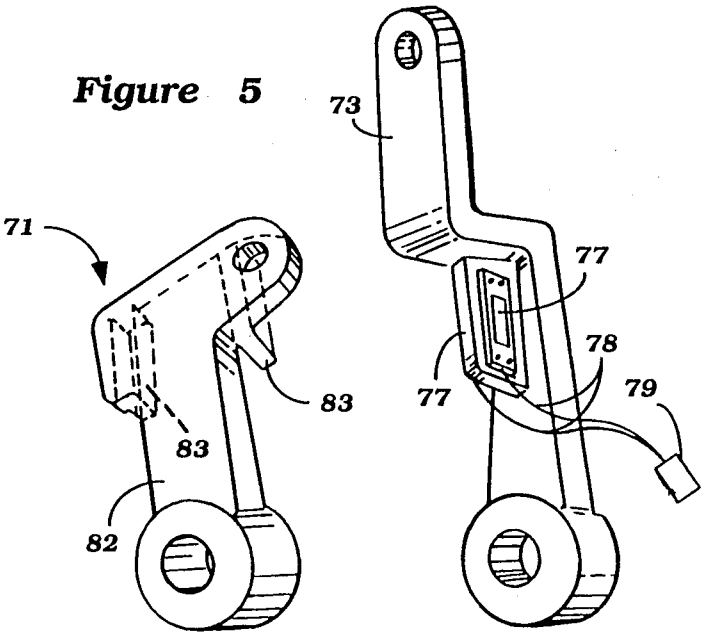
FIG. 5 is a further enlarged, partially exploded perspective view.
Figure 4:
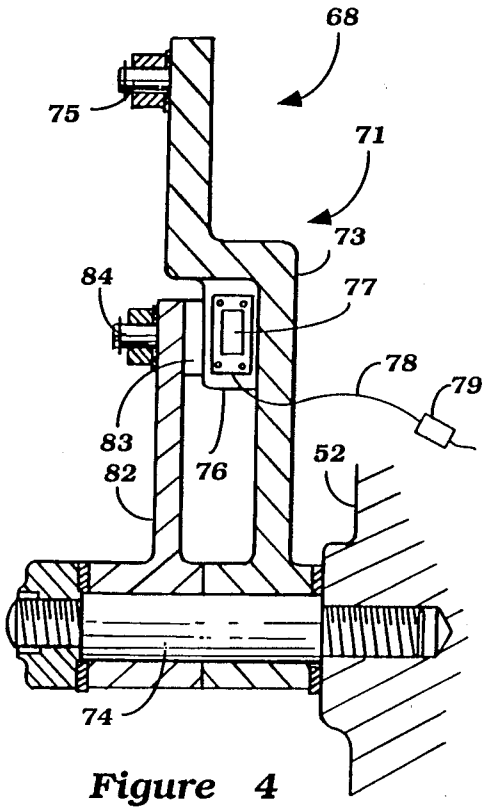
FIG. 4 is a cross-sectional view taken along the line 4—4 of the FIG. 3.

A second lever arm 82 is journaled on the pivot shaft 74 in proximity to the lever arm 73. The lever arm 82 has a pair of lugs 83 that extend on opposite sides of the pressure responsive switches 77 and which are normally spaced from them by a distance S as shown in FIG. 3 so as to provide a slight clearance when the device is not under load. The wire actuator 72 is connected by means of a pivot pin 84 to the lever arm 82.

When a shift is being made, the wire actuator 69 will effect pivotal movement of the lever arm 73 in the appropriate direction and the clearance S will be taken up. The switch 77 will then contact one of the lugs 83 and effect pivotal movement of the lever arm 82. In the event more than a predetermined resistance to pivotal movement is encountered, as may be set by the construction of the pressure responsive switch 77 in a known manner, a signal will be outputed through the conductor 78 to the shift assisting control circuit 81 to provide shift assisting control. Therefore, it should be readily apparent that a very simple yet highly effective shift assist control has been provided which is much less complicated than the previous construction and also much more compact. Also, because the construction is less complicated it is also will be more reliable.

Although an embodiment of the invention has been illustrated and described, various changes and modifications may be made without departing from the spirit and scope of the invention, as defined by the appended claims.

I claim:

1. In a shift assisting device for a transmission comprised of a shift controlling member, a transmission controlling member and motion transmitting means for transmitting movement of said shift controlling member into movement of said transmission controlling member, the improvement comprising said motion transmitting means including a first element moveable with said shift controlling member, a second element moveable with said transmission controlling member, and pressure responsive switch means interposed between said elements, said pressure responsive switch means being effective for transmitting forces from said first element upon its movement to said second element to effect its movement, said pressure responsive switch means providing a shift assisting signal only when the resistance to movement of said second element exceeds an amount indicating a resistance of said transmission to be shifted.

2. In a shift assisting device as set forth in claim 1 wherein the first and second elements comprise pivotally supported levers juxtaposed to each other.

3. In a shift assisting device as set forth in claim 2 wherein there are a pair of oppositely facing pressure responsive switches carried by one of the levers and engaged by a pair of complementary lugs carried on the other of the levers.

4. In a shift assisting device as set forth in claim 3 wherein the motion transmitting means further includes a first wire actuator connected to the first of the levers and a second wire actuator connected to the other of the levers.

5. In a shift assisting device as set forth in claim 4 in combination with a marine outboard transmission and wherein the transmission control member comprises a dog clutching sleeve movable between forward neutral and reverse conditions.

* * * * *

UNITED STATES PATENT AND TRADEMARK OFFICE

CERTIFICATE OF CORRECTION

PATENT NO. : 4,973,274

DATED : November 27, 1990

INVENTOR(S) : Itsushi Hirukawa

It is certified that error appears in the above-identified patent and that said Letters Patent is hereby corrected as shown below:

On title page, item [30], insert the following:

--Foreign Application Priority Data--

--Jan. 18, 1988 [JP] Japan ..... 63-6915--

Signed and Sealed this

Thirtieth Day of March, 1993

*Attest:*

STEPHEN G. KUNIN

*Attesting Officer*

*Acting Commissioner of Patents and Trademarks*